US006607046B1

(12) United States Patent
Betts et al.

(10) Patent No.: US 6,607,046 B1
(45) Date of Patent: Aug. 19, 2003

(54) EXPANDABLE DRILL BIT

(75) Inventors: Michael John Betts, Rijswijk (NL); Timothy William Rhys Harris, Aberdeen (GB); Neil Andrew Abecrombie Simpson, Aberdeen (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/710,379

(22) Filed: Nov. 10, 2000

(30) Foreign Application Priority Data

Nov. 12, 1999 (EP) ..... 99309012

(51) Int. Cl.[7] ..... E21B 10/32
(52) U.S. Cl. ..... 175/272; 175/382
(58) Field of Search ..... 175/319, 342, 175/343, 382, 384, 55, 272

(56) References Cited

U.S. PATENT DOCUMENTS 1,745,650 A * 2/1930 Santiago ..... 175/273
1,834,337 A * 12/1931 Crum ..... 175/271
2,382,725 A * 8/1945 Koppl et al. ..... 175/271
4,591,010 A * 5/1986 Persson ..... 175/320
5,009,274 A * 4/1991 Lof ..... 175/260
5,186,265 A 2/1993 Henson et al.
6,076,618 A * 6/2000 Asberg ..... 175/385
6,112,835 A * 9/2000 Grafe et al. ..... 175/258

FOREIGN PATENT DOCUMENTS

GB 2031481 4/1980
WO 91/10805 A 7/1991

* cited by examiner

*Primary Examiner*—Thomas B. Will
*Assistant Examiner*—Daniel P Stephenson

(57) ABSTRACT

A drill bit suitable to be connected to a drill string for drilling a borehole into an earth formation, the drill string having a central longitudinal axis, the drill bit comprising a bit body connectable to the lower end of the drill string, and a cutting member provided with cutting devices at the outer surface thereof, the cutting member being rotatable relative to the bit body about a longitudinal axis of rotation extending eccentrically relative to the central longitudinal axis of the drill string, between a first rotational position[ and a second rotational position, whereby in said second rotational position the cutting devices arranged at a larger radial distance from the central longitudinal axis of the drill string than in said first rotational position.

12 Claims, 3 Drawing Sheets

EXPANDABLE DRILL BIT

Figure 1:
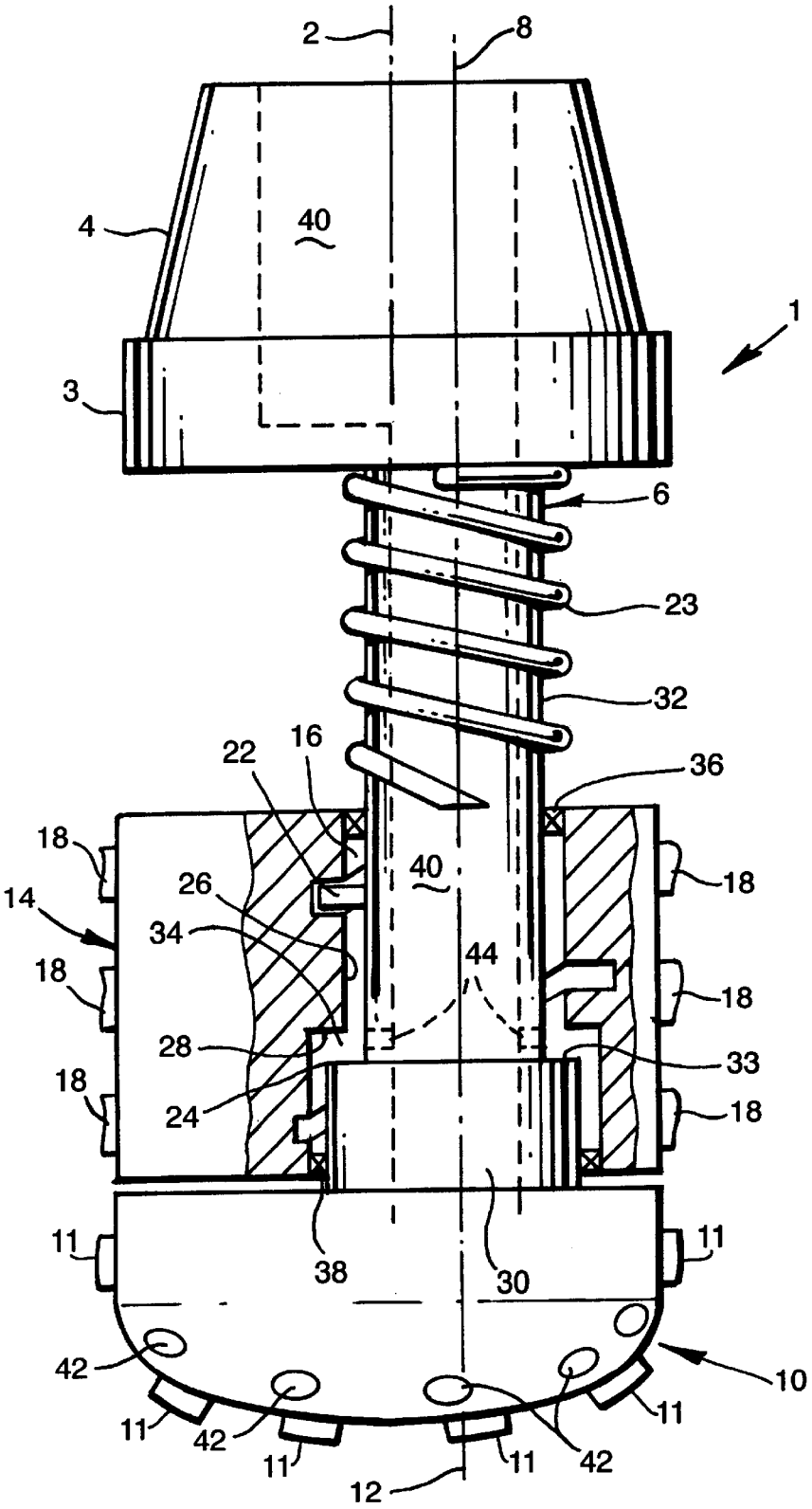

The present invention relates to a drill bit for use in combination with a drill string for drilling a borehole into an earth formation. In the industry of drilling wellbores it is conventional practice to drill boreholes at stepwise decreasing diameters in downward direction. This is normally a consequence of the casing or liner program whereby casing or liner sections of stepwise decreasing diameters are installed in the wellbore. In such arrangement each next lower casing or liner section extends through a previously installed section. As a result the upper part of the wellbore has to be drilled at a significantly larger diameter than the lower parts of the wellbore, thereby increasing the costs of drilling.

It is desirable to reduce the costs of drilling and to provide a drill bit which obviates the need for a stepwise decreasing borehole diameter.

Furthermore, it is desirable to provide a drill bit which is capable of underreaming an existing borehole.

In accordance with the invention there is provided a drill bit suitable to be connected to a drill string for drilling a borehole into an earth formation, the drill string having a central longitudinal axis, the drill bit comprising a bit body connectable to the lower end of the drill string; and a cutting member provided with cutting means at the outer surface thereof, the cutting member being rotatable relative to the bit body about a longitudinal axis of rotation extending eccentrically relative to the central longitudinal axis of the drill string, between a first rotational position and a second rotational position, whereby in said second rotational position the cutting means is arranged at a larger radial distance from the central longitudinal axis of the drill string than in said first rotational position.

It is thereby achieved that by rotating the cutting member from the first rotational position to the second rotational position, the cutting diameter of the drill bit increases. In an attractive application the drill string with the drill bit connected thereto, is lowered through a casing of an upper borehole portion to an uncased lower borehole portion while the cutting member is in the first rotational position. Thereafter a further borehole section is drilled with the cutting member in the second rotational position, whereby the diameter of the newly drilled portion is larger than the internal diameter of the casing through which the drill bit was lowered. A new casing section is then lowered through the upper casing into the lower borehole portion, which new casing section then is expanded against the borehole wall. Thus, the borehole diameter is allowed to remain unchanged in downward direction.

Preferably the direction of rotation of the cutting member from the first rotational position to the second rotational position is opposite the direction of rotation of the drill string during normal drilling of the borehole using the drill string and the drill bit. When the drill string starts rotating with the cutting member in the first rotational position, the cutting member is subjected to a drag force due to contact with the borehole wall, which drag force induces the cutting member to rotate in opposite direction relative to the bit body. As a result the cutting member rotates from the first rotational position to the second rotational position thereof, whereby the cutting diameter of the drill bit increases.

Advantageously the cutting member is movable in axially direction relative to the bit body between a primary axial position and a secondary axial position, wherein in the primary axial position the cutting member is located closer to the lower end of the drill string than in the secondary axial position, and wherein the bit body and the cutting member are provided with co-operating guide means for guiding the cutting member from the first rotational position to the second rotational position upon movement of the cutting member from the primary axial position to the secondary axial position. Thus, the cutting member can be moved from the first to the second rotational position by, for example, applying weight to the drill string resulting in lowering of the string whereby the drag forces from the borehole wall induce the cutting member to move from the primary to the secondary axial position. Alternatively, or in addition, such axial movement can be achieved by operating a hydraulic actuator incorporated in the drill string.

Figure 2:
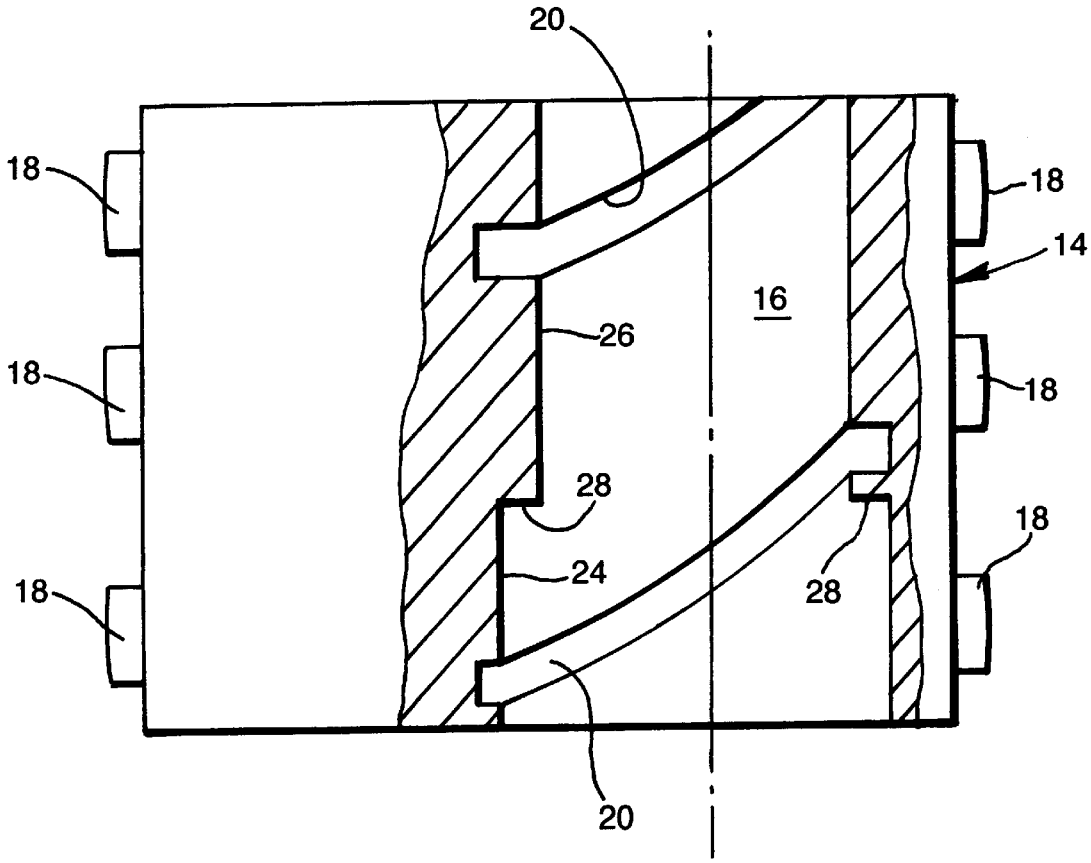
Figure 3:
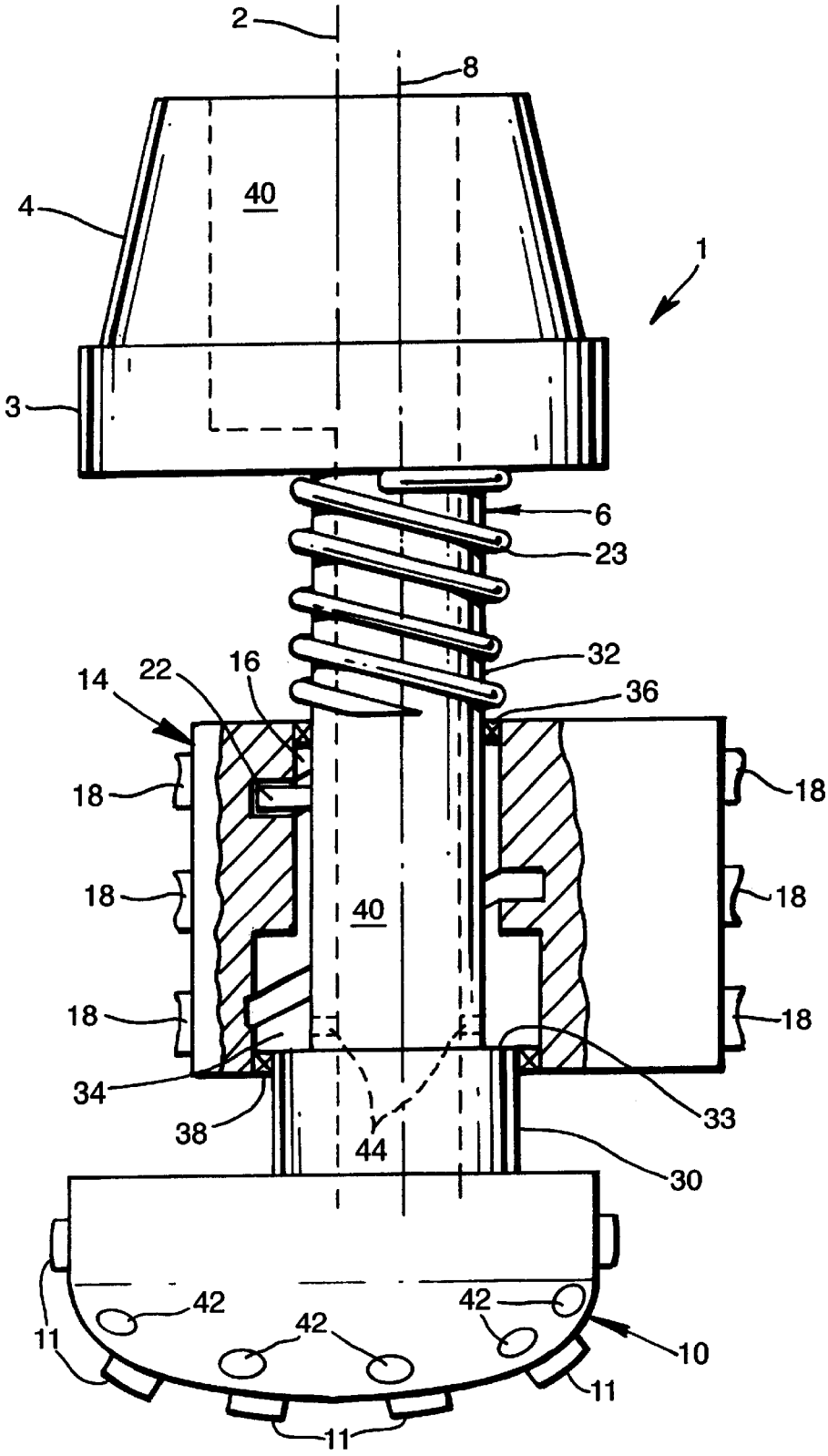

The invention will be described hereinafter in more detail and by way of example, with reference to the accompanying drawings in which:

FIG. 1 schematically shows a longitudinal view, partially in cross-section, of an embodiment of the drill bit according to the invention in a first mode of operation;

FIG. 2 schematically shows a longitudinal view, partially in cross-section, of a cutting member applied in the embodiment of Fig. 1; and FIG. 3 schematically shows a longitudinal view, partially in cross-section, of the embodiment of FIG. 1 in a second mode of operation.

Referring to FIG. 1 there is shown a drill bit 1 for use in combination with a drill string (not shown) for drilling a borehole into an earth formation, the drill string having a central longitudinal axis 2. The drill bit 1 includes a bit body 3 of substantially circular cross-section, provided with a connector 4 for connecting the drill bit 1 to the drill string. The drill bit 1 furthermore includes a tubular shank 6 connected to the bit body 3 at the side thereof opposite the connector 4, the shank having a central longitudinal axis 8 extending substantially parallel to the axis 2. Thus, the shank 6 extends eccentrically relative to the drill string when the drill bit 1 is connected to the drill string by connector 4. A pilot bit 10 is connected to the shank 6 at the end thereof opposite the bit body 3. The pilot bit 10 is of substantially circular cross-sectional shape with a diameter slightly larger than the diameter of the bit body 3 and has a central longitudinal axis 12 coinciding with the central longitudinal axis 2 of the drill string when the drill bit 1 is connected to the drill string.

A cutting member 14 is arranged between the bit body 3 and the pilot bit 10, and is provided with a longitudinal bore 16 through which the shank 6 extends in a manner allowing rotation of the cutting member 14 around the shank. The cutting member 14 has a substantially circular cross-section and is provided with a plurality of cutting inserts 18 arranged at the outer surface thereof, the outer diameter of the cutting member 14 being substantially equal to the diameter of the pilot bit 10. The bore 16 extends eccentrically relative to the central longitudinal axis of the cutting member 14 such that the cutting member is rotatable around the shank between a first rotational position in which the central longitudinal axis of the cutting member 14 substantially coincides with the central longitudinal axis of the pilot bit 10, and a second rotational position in which the cutting member 14 is rotated about 180° from the first rotational position. In terms of eccentricity of the cutting member 14 relative to the pilot bit 10, this implies that in the first rotational position the eccentricity is non-existing whereas in the second rotational position the eccentricity is maximal.

Apart from being rotatable around the shank 6, the cutting member 14 is movable in axial direction along the shaft 6 between a primary axial position and a secondary axial position, wherein in the primary axial position the cutting member 14 is positioned against the pilot bit and in the secondary axial position the cutting member 14 is positioned closer to the bit body 3.

Referring further to FIG. 2, the bore 16 of the cutting member 14 is provided with one or more helical threads 20 (only one of which is shown) extending along the length of the bore, which thread 20 is indicated in more detail in FIG. 2 showing the cutting member 14 removed from the shank. The shank 6 is provided with a number of protrusions in the form of a dogs 22 (only one of which is shown) extending into the helical thread 20. The relative orientation of the thread 20 and the dog 22 is such that when the cutting member 14 rotates from the first rotational position to the second rotational position with a direction of rotation opposite the direction of rotation of the drill string during normal drilling, the dogs 22 guide the cutting member 14 from the primary axial position to the secondary axial position. A helical spring 23 arranged between the bit body 3 and the cutting member 14 biases the cutting member 14 to the primary axial position thereof.

The bore 16 has a large diameter part 24 at the side of the pilot bit 10 and a small diameter part 26 at the side of the bit body 3, with an annular shoulder 28 between the large diameter part 24 and the small diameter part 26. Similarly, the shank has a large diameter part 30 extending into the large diameter part 24 of the bore, and a small diameter part 32 extending into the small diameter part 26 of the bore, with an annular shoulder 33 between the large diameter part 30 and the small diameter part 32. The relative position of the annular shoulders 28, 33 is such that in the primary axial position of the cutting member 14 a relatively small annular space 34 is formed between the shoulders 28, 33. The bore 16 is sealed relative to the shank 6 by annular seals 36, 38 arranged along the bore 16. The drill bit is provided with a drilling fluid passage 40 for the supply of drilling fluid to conventional nozzles 42 arranged at the pilot bit 10, which passage 38 extends through the shank 6 and is in fluid communication with the space 34 by two ports 44 provided in the wall of the shank 6.

During normal operation the drill bit 1 is connected to the drill string by means of the connector 4, and the drill string is lowered into a borehole (not shown) formed into an earth formation. The borehole has been cased to a certain depth whereby an uncased borehole section extends below the casing, and the internal diameter of the casing is smaller than the diameter of the uncased borehole section. Lowering is proceeded until the drill bit 1 is positioned in the uncased borehole section, whereby during lowering the spring holds the cutting member 14 in the primary axial position (FIG. 1) so that the drill bit 1 fits in the casing.

After the drill bit 1 has been positioned in the uncased borehole section, drilling fluid is pumped through drifting fluid passage 40 and the drill string is rotated so as to start drilling of a further borehole section. Upon pumping drilling fluid through the passage 40, drilling fluid is pumped through the ports 44 into the annular space 34. As a result the fluid pressure on the annular shoulder of the cutting member 14 rises and thereby the fluid pressure biases the cutting member 14 towards the secondary axial position. Thus, the bore 16 and the shank 6 act as a hydraulic actuator for moving the cutting member 14 from the primary axial position to the second axial position upon application of fluid pressure in the fluid passage 40. The drill bit 1 with the cutting member 14 in the second rotational position and in the secondary axial position is shown in FIG. 3.

Movement of the cutting member 14 from the primary axial position to the second axial position is promoted by rotation of the drill bit 1 in the borehole whereby the cutting member 14 contacts the borehole wall and consequently is subjected to a drag force inducing rotation of the cutting member 14 relative to the bit body 3 in direction opposite the direction of rotation of the drill string. As explained hereinbefore, the arrangement of helical thread 20 and dogs 22 induces the cutting member 14 to move from the primary axial position to the secondary axial position upon such relative rotation.

During movement of the cutting member 14 from the primary axial position to the secondary axial position, the arrangement of helical thread 20 and dogs 22 induces the cutting member 14 to rotate from the first to the second rotational position thereof. When the cutting member 14 arrives at the second rotational position, a suitable stop surface (not shown) prevents further relative rotation of the cutting member 14. In this position the cutting member 14 is at maximum eccentricity relative the pilot bit 10. Rotation of the drill string is proceeded and, as a result, the borehole is further drilled to a larger diameter than the internal diameter of the casing through which the drill string was lowere.

Once drilling of the new borehole section is finalised, rotation of the drill string is stopped an pumping of drilling fluid is stopped. The cutting member 14 then is no longer biased to the secondary axial position, and the spring acts to move the cutting member 14 back to the primary axial position. The drill string can now be removed from the borehole through the casing installed earlier.

Subsequently a new casing section is lowered through the casing installed earlier, which casing section obviously has a smaller outer diameter than the inner diameter of the casing already installed. After the new casing section has arrived in the newly drilled borehole section, the new casing section is expanded in a known manner to a diameter substantially equal to the diameter of the casing installed earlier. In this manner it is achieved that the internal diameter of the casing in the borehole remains more or less constant throughout the depth of the borehole, instead of the nested arrangement of casings in conventional boreholes.

Instead of applying the aforementioned dogs for guiding the cutting member along the shank, the shank is suitably provided with one or more threads which correspond in number and orientation to the threads of the cutting member, in a manner that the threads of the shank extend parallel to the threads of the cutting member, and whereby one of more bearing balls are arranged between the threads of the shank and the threads of the cutting member.

What is claimed is:

1. A drill bit suitable to be connected to a drill string for drilling a borehole into an earth formation, the drill string having a central longitudinal axis, the drill bit comprising:

a bit body connectable to the lower end of the drill string; and a cutting member provided with cutting means at the outer surface thereof, the cutting member being rotatable relative to the bit body about a longitudinal axis of rotation extending eccentrically relative to the central longitudinal axis of the drill string, between a first rotational position and second rotational position, whereby in said second rotational position the cutting means is arranged at a larger radial distance from the central longitudinal axis of the drill string than in said first rotational position, wherein the cutting member is movable in an axial direction relative to the bit body between a primary axial position and a secondary axial position, wherein in the primary axial position the cutting member is located closer to the lower end of the drill bit than in the secondary axial position.

2. The drill bit of claim 1, wherein the direction of rotation of the cutting member from the first rotational position to the second rotational position is opposite the direction of rotation of the drill string during normal drilling of the borehole using the drill string and the drill bit.

3. The drill bit of claim 2, wherein the bit body and the cutting member are provided with co-operating guide means for guiding the cutting member from the first rotational position to the second rotational position upon movement of the cutting member from the primary axial position to the secondary axial position.

4. The drill bit of claim 3, wherein said guide means include a helical guide surface provided at one of the bit body and cutting member.

5. The drill bit of claim 4, wherein the helical guide surface is formed by a helical thread and the guide means includes a guide member arranged to be guided by the thread.

6. The drill bit of claim 5 wherein the guide means in helical thread provided at the bit body, a second helical thread provided at the cutting member and extending substantially parallel to the first helical thread, and at least one bearing ball arranged between the first and second helical threads.

7. The drill bit of claim 6, further comprising hydraulic actuator means for moving the cutting member from the primary axial position to the secondary axial position by the action of fluid pressure of a body of drilling fluid present in a drilling fluid passage of the drill string.

8. The drill bit of claim 7, further comprising spring means arranged to bias the cutting member from the secondary axial position to the primary axial position.

9. The drill bit of claim 8, wherein the bit body is provided with a shank having a central longitudinal axis coinciding with said axis of rotation, and the cutting member is provided with a bore through which the shank extends, the cutting member being rotatable between said first and second rotational positions around the shank.

10. The drill bit of claim 9, wherein the bit body is provided with a pilot bit arranged at the front end of the drill bit, the pilot bit head being connected to the bit body by the shank.

11. The drill bit of claim 10, wherein the cutting means of the cutting member in the first rotational position thereof has a cutting envelope substantially equal to a cutting envelope of the pilot bit.

12. The drill bit of claim 11, wherein the hydraulic actuator means includes an annular space formed between the bore and the shank and in fluid communication with a drilling fluid passage extending through the drill string, and wherein the cutting member is provided with a pressure surface formed in the bore and being oriented so as to bias the cutting member from the primary axial position to the second axial position upon application of fluid pressure in the fluid passage.

* * * * *